United States Patent [19]

Greaves

[11] 4,058,995

[45] Nov. 22, 1977

[54] LOCK DE-ICER

[76] Inventor: Cecil Greaves, 168-42 127th Ave., Jamaica, N.Y. 11434

[21] Appl. No.: 717,036

[22] Filed: Aug. 24, 1976

[51] Int. Cl.[2] ..... E05B 17/00

[52] U.S. Cl. ..... 70/431; 206/37; 206/218; 220/8; 138/35; 138/155; 138/178; 181/178; 141/337

[58] Field of Search ..... 206/37, 218; 220/8; 70/431; 138/32, 35, 155, 178; 141/337, 338, 342, 297; 222/523, 525, 527, 398; 181/178, 184

[56] References Cited

U.S. PATENT DOCUMENTS

| | | | |
|---|---|---|---|
| 21,955 | 11/1858 | Grosholz | 206/218 |
| 1,293,273 | 2/1919 | Welshausen | 138/35 |
| 1,631,951 | 6/1927 | McAnsh | 222/523 |
| 1,740,418 | 12/1929 | Donnelly | 141/337 |
| 2,804,242 | 8/1957 | Borah | 222/527 X |
| 3,101,904 | 8/1963 | Prussin et al. | 222/523 X |
| 3,121,408 | 2/1964 | Haning | 220/8 X |

*Primary Examiner*—Richard E. Aegerter
*Assistant Examiner*—James E. Bryant, III

[57] ABSTRACT

A telescoping hollow tube provides means for channeling warm human breath onto a frozen lock. The warm breath thaws the lock. When not in use, the tube telescopes to a small size for easy portability.

1 Claim, 4 Drawing Figures

LOCK DE-ICER

BACKGROUND OF THE INVENTION

People living in northern areas often encounter frozen locks. Motor vehicle locks are especially susceptible to this problem.

The prior art teaches electic resistance heating devices which thaw the lock such as in U.S. Pat. Nos. 2,530,513; 3,192,359; 3,662,149; 2,538,872 and 2,774,855. Other devices heat the key which in turn thaws the lock. Key heaters of the electric as in U.S. Pat. No. 3,450,859 and fossil fuel as in U.S. Pat. No. 3,023,749 varieties have been developed. A protable chemical stream generator in U.S. Pat. No. 2,621,648 thaws the lock with a jet of steam.

All of the devices in the prior art require power of some sort, such as electrical or chemical, for their operation.

SUMMARY OF THE INVENTION

The present invention relates to devices for thawing locks.

Applicant has discovered that, if the human breath is directed on a frozen lock using a channel with a lateral opening in its side, the flow of warm breath will thaw the lock.

The applicant's lock de-icer consists of a graduated set of telescoping frusto-conical rings which can be extended to form a tube through which warm breath can be channeled to the lock. The section of the device nearest the lock is of resilient material such as rubber or plastic adapted to deform to sealing engagement with the vehicle surface surrounding the lock. This seal prevents escape of the warm air. At least one opening in the side of the channel allows the continued flow of warm breath to the lock without allowing excessive entry of cold air.

An integral container enables compact carriage of the lock de-icer on the person of the potential user.

DETAILED DISCLOSURE OF THE PREFERRED EMBODIMENT

Figure 1:
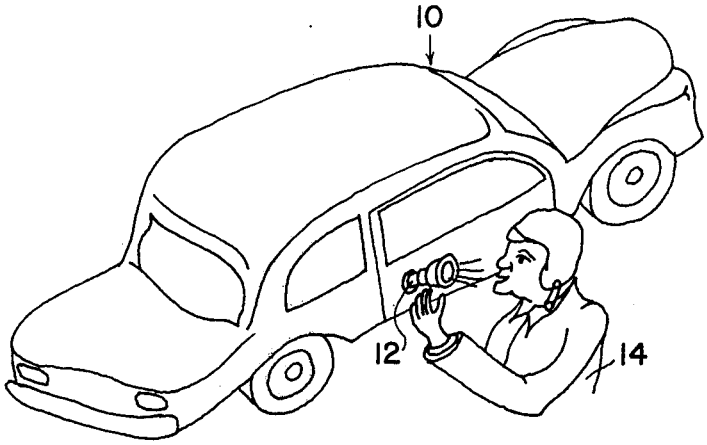
FIG. 1 shows a lock de-icer being used to thaw the frozen lock of an automobile.

Referring to FIG. 1, an automobile 10 having a frozen lock is shown with the lock de-icer 12 pressed against the door surface surrounding the lock. The user 14 blows his breath into the tube formed by the de-icer 12.

Figure 2:
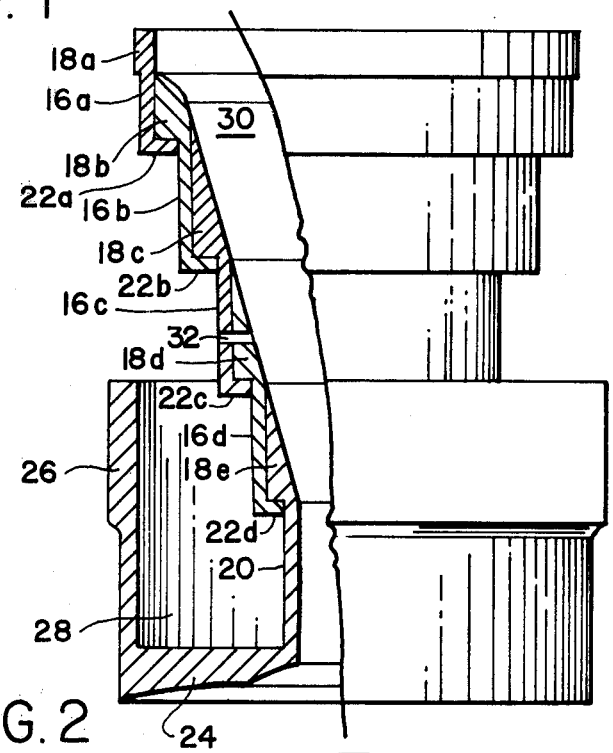
FIG. 2 shows a side elevation of the lock de-icer in partial cross-section.

Referring to FIG. 2, the lock de-icer is made up of a plurality of telescoping annular segments 16*a*, 16*b*, 16*c*, 16*d*. Each segment has an outward-directed flange 18*a*, 18*b*, 18*c*, 18*d*, 18*e* at its upper end and all but the bottom segment 20, has an inward directed flange 22*a*, 22*b*, 22*c*, 22*d* at its lower end. The outward directed and inward directed flanges interfere to limit the extension of the de-icer. It is to be understood that the limitation of extension can be created in alternate ways, such as telescoping frusto-conical annular sections without departing from the spirit of the invention.

The bottom segment 20 has a wide outward-directed flange 24 at its lower end. The outward directed flange 23 is connected to an outer ring 26 which extends parallel to the upper level of the lower section 20. The outer ring 26 forms within it an annular channel 28 into which all of the telescoping segments 16 may collapse and be stored.

At least the wide outward-directed flange 24 should preferably be made of resilient material such as rubber or plastic in order that it may deform to sealably fit the contour of the vehicle door surrounding the lock.

The interior of the telescoping annular segments 16*a*, 16*b*, 16*c*, 16*d* and bottom segment 20 form an air-directing channel 30 through which air may be directed to the frozen lock.

An air exhaust hole 32 in the side of one of the telescoping annular segments allows a controlled amount of breath to escape in order to maintain a flow of warm air toward the frozen lock.

Figure 3:
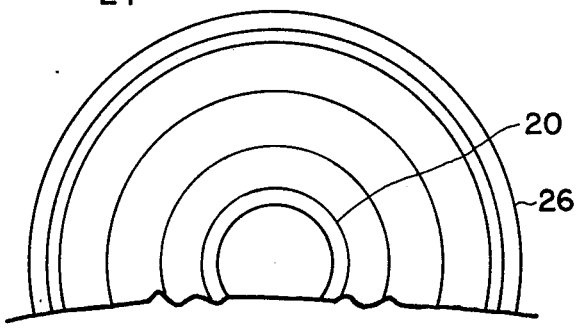
FIG. 3 shows a fragmentary top view of the lock de-icer.

The top view in FIG. 3 shows how the telescoping annular segments decrease in diameter from outside to inside.

Figure 4:
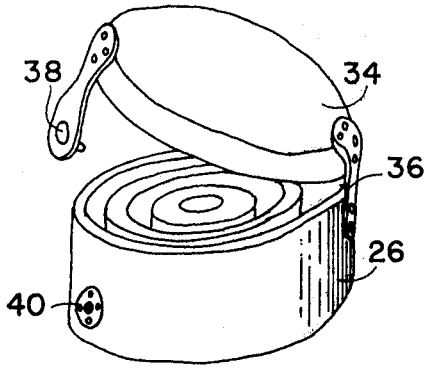
FIG. 4 shows the lock de-icer telescoped in its integral container.

FIG. 4 shows an alternative configuration in which a cover 34 is attached by a flexible hinge 36 to the outer ring 26. A pin latch 38 at the other side of the cover 34 is adapted to engage a cooperating latch hole 40 to retain the cover in position when it is not in use.

It will be understood that the claims are intended to cover all changes and modifications of the preferred embodiments of the invention, herein chosen for the purpose of illustration which do not constitute departures from the spirit and scope of the invention.

What is claimed is:

1. A lock de-icer comprising:

a. a plurality of telescoping annular segments;

b. said segments, when extended forming a hollow generally conical channel;

c. one of the end segments of said plurality of annular segments having an outward directed flange of resilient material attached at the outer extremity thereof, said outward directed flange being deformable whereby it may be deformed to sealingly abut the curved surface of a vehicle surrounding the vehicle door lock;

d. an air release hole providing open communication for air from the inside to the outside of one of said telescoping annular segments;

e. an outer ring attached to the perimeter of said outward directed flange, said outer ring being coaxial with said one of the end segments and forming between itself and said one of the end segments an annular cavity in which all others of the telescoping annular segments may be contained;

f. a cover adapted to sealingly fit over the end of said outer ring remote from said outward directed flange and to hold said all others of the telescoping annular segments within said annular cavity, and g. said cover being flexiby hinged to said outer ring.

* * * * *